United States Patent [19]

Sollie et al.

[11] Patent Number: 4,518,050

[45] Date of Patent: May 21, 1985

[54] ROTATING DOUBLE BARREL CORE SAMPLER

[75] Inventors: Steinar Sollie; Arild A. Andresen, both of Oslo, Norway

[73] Assignee: Chevron Research Company, San Francisco, Calif.

[21] Appl. No.: 509,891

[22] Filed: Jun. 30, 1983

[51] Int. Cl.[3] ..... E21B 25/00; E21B 49/02

[52] U.S. Cl. ..... 175/250; 175/58; 175/246; 73/864.45

[58] Field of Search ..... 73/864.45, 864.44; 175/58, 403, 404, 246, 244, 247, 248, 249, 250, 253, 254, 296, 239, 240, 236, 309, 332, 333, 330, 20

[56] References Cited

U.S. PATENT DOCUMENTS

| | | | |
|---|---|---|---|
| 1,741,497 | 12/1929 | Boltz | 175/248 X |
| 1,994,848 | 3/1935 | Baker et al. | 175/244 |
| 2,260,678 | 10/1941 | Muhlbach | 175/249 |
| 2,403,002 | 7/1946 | Johnson | 175/239 |
| 2,557,925 | 6/1951 | Stokes | 73/864.44 X |
| 2,709,069 | 5/1955 | Boucher | 175/249 X |
| 2,898,086 | 8/1959 | Freeman, Jr. et al. | 175/58 |
| 2,906,341 | 9/1959 | Kellner et al. | 175/246 X |
| 2,910,273 | 10/1959 | Bon | 175/246 X |
| 2,915,285 | 12/1959 | Deily | 175/246 X |
| 2,944,792 | 7/1960 | Gros | 175/246 X |

FOREIGN PATENT DOCUMENTS

| | | | |
|---|---|---|---|
| 302464 | 4/1971 | U.S.S.R. | 175/403 |

OTHER PUBLICATIONS

Rotary Core Barrel Article; *The Oil Weekly;* pp. 102–114; May 1936.

Fugro Ltd., Letter dated 14 May 82, with one page attachment.

Ocean Industry article, date Dec. 1982, one page.

General Description of Hydraulic Breaker, one page.

*Primary Examiner*—S. Clement Swisher

*Assistant Examiner*—Tom Noland

*Attorney, Agent, or Firm*—Edward J. Keeling; S. R. LaPaglia

[57] ABSTRACT

The present invention provides disclosure of a core sampler that includes a rotatably extending outer barrel containing a relatively non-rotating core barrel which is extendable with the outer barrel in response to drilling mud pressure into the material to be cored by a mud turbine which rotates the outer barrel. The core sampler may be run in and out of a drill string on a wire line.

5 Claims, 7 Drawing Figures

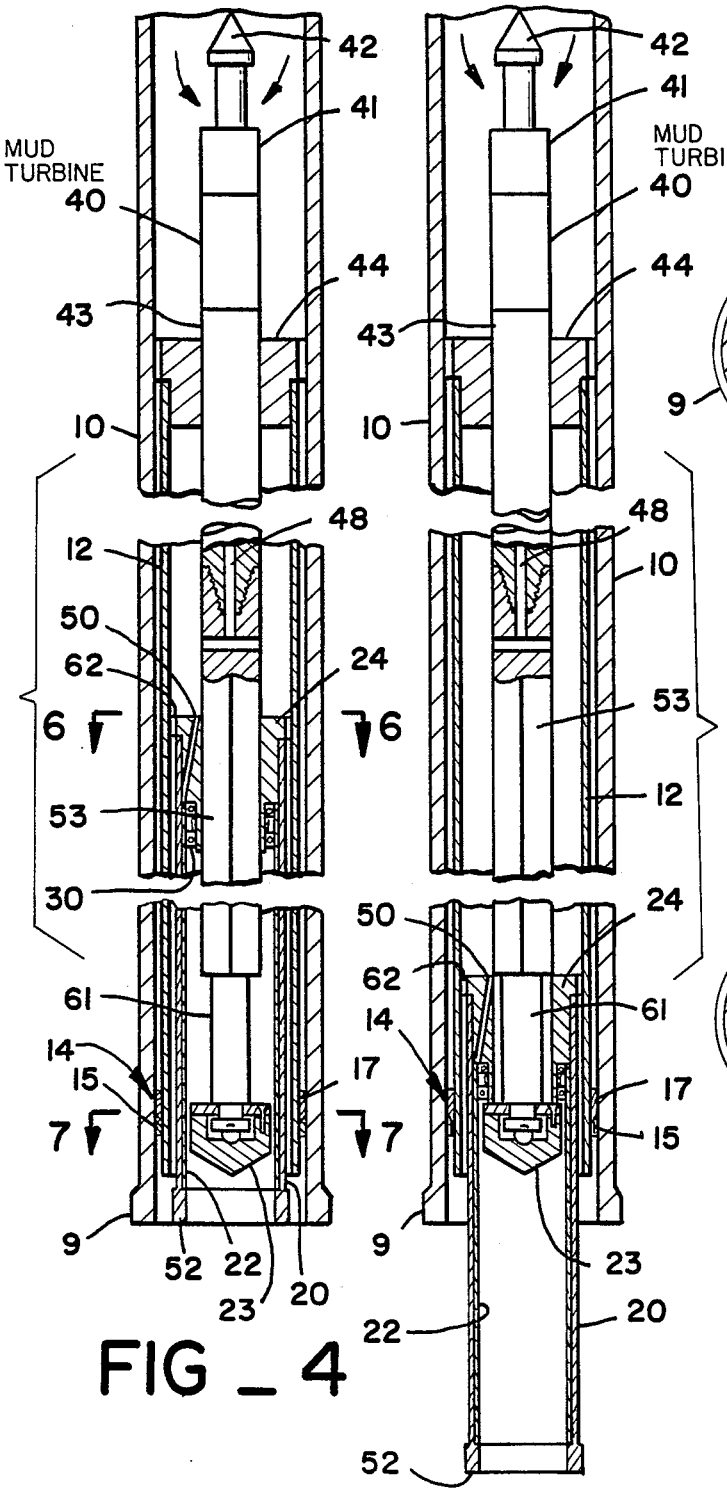
FIG _ 4
FIG _ 5
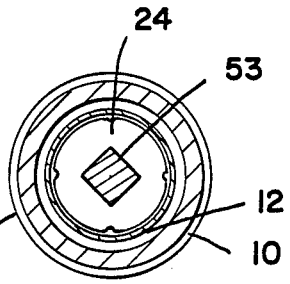
FIG _ 6
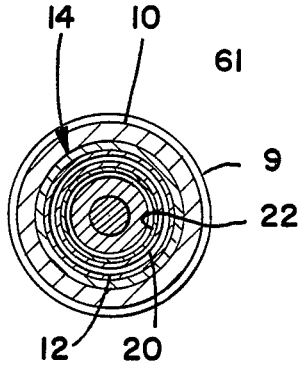
FIG _ 7

ROTATING DOUBLE BARREL CORE SAMPLER

CROSS REFERENCES TO RELATED APPLICATIONS

This application is related to copending applications Ser. No. 509,889 and Ser. No. 509,892, both filed June 30, 1983, and both assigned to the assignee of this application.

BACKGROUND OF THE INVENTION

It is important to have good care samples particularly in offshore work. This is especially true in offshore site investigation which is a prerequisite to foundation analysis for offshore structures, and the like.

Heretofore piston samplers have been used to obtain offshore core samples. These samplers have required a substantial amount of extraneous equipment such as compensators and bumper subs on the drill string as well as heavy jacks for gripping the sea floor during sampling. There is need therefore for improved samplers having simplicity and durability.

BRIEF DESCRIPTION OF PREFERRED EMBODIMENT

Broadly, the present invention provides a wire line core sampler for use in a drill string sub. A cylindrical guide tube is removably insertable into the sub. An outer cylindrical barrel is rotatably and reciprocally mounted within the guide tube and is extendable out through the lower end of the sub. A core barrel is positioned within the outer cylindrical barrel. Downhole means responsive to liquid pressure in the drill string are provided for rotating the outer barrel and for extending the outer barrel and the core barrel through the lower end of the sub to take a soil sample.

More particularly, the present invention provides a wire line rotating barrel core sampler for use in a drill string. A tubular cylindrical sub connectable to the lower end of a drill string is provided and, in operation, is connected to the lower end of an elongated drill string. A cylindrical guide tube is removably insertable into the sub. Mud seal means are positioned for closing off the annular space between the tubular sub and the guide tube and for preventing the guide tube from extending out of the lower end of the sub. An outer cylindrical barrel is rotatably and reciprocally mounted within the guide tube and is extendable out through the lower ends of the guide tube and the sub. A core barrel is positioned within the outer cylindrical barrel. Adaptor means having an off round central opening therethrough connect the core barrel to the outer cylindrical barrel for reciprocal movement therewith without substantial rotation therewith. An elongated rod extends through the off round opening of the adaptor means. The rod has an upper portion shaped to engage the off round opening for rotating the adaptor means and a lower portion shaped to rotate freely within the off round opening. Upper sleeve means are connected to the upper end of the guide tube. The sleeve means has a central opening therein. A mud turbine for rotating the rod is connected to the elongated rod through the central opening in the upper sleeve means. Mud exhaust means are formed in the mud turbine for exhausting mud into the space between the adaptor means and the upper sleeve means. Restricted mud flow passageway means are provided to permit a portion of the mud to flow past the adaptor means and a portion of the mud to flow through the annular space between the outer cylindrical barrel and the core barrel and then in both instances out of the sub.

OBJECTS OF THE INVENTION

It is a principal object of the present invention to provide a rotating double barrel wire line core sampler that is operated by drilling mud pressure from the mud system of a drilling ship or the like. Additional objects and advantages of the present invention will become apparent from reading the following detailed description in view of the accompanying drawings which are made a part of this specification.

BRIEF DESCRIPTION OF THE DRAWINGS

FIG. 4 is a sectional elevation view similar to FIG. 1 but in smaller scale showing the preferred embodiment of apparatus assembled in accordance with the present invention with the core barrel shown in retracted position within the drill string bottom sub;

FIG. 5 is a sectional elevation view showing the preferred embodiment of apparatus assembled in accordance with the present invention with the core barrel extended out of the drill string bottom sub in sampling position;

FIG. 6 is a sectional view taken at 6—6 of FIG. 4; and

FIG. 7 is a sectional view taken at 7—7 of FIG. 4.

DETAILED DESCRIPTION OF THE INVENTION

Figure 1:
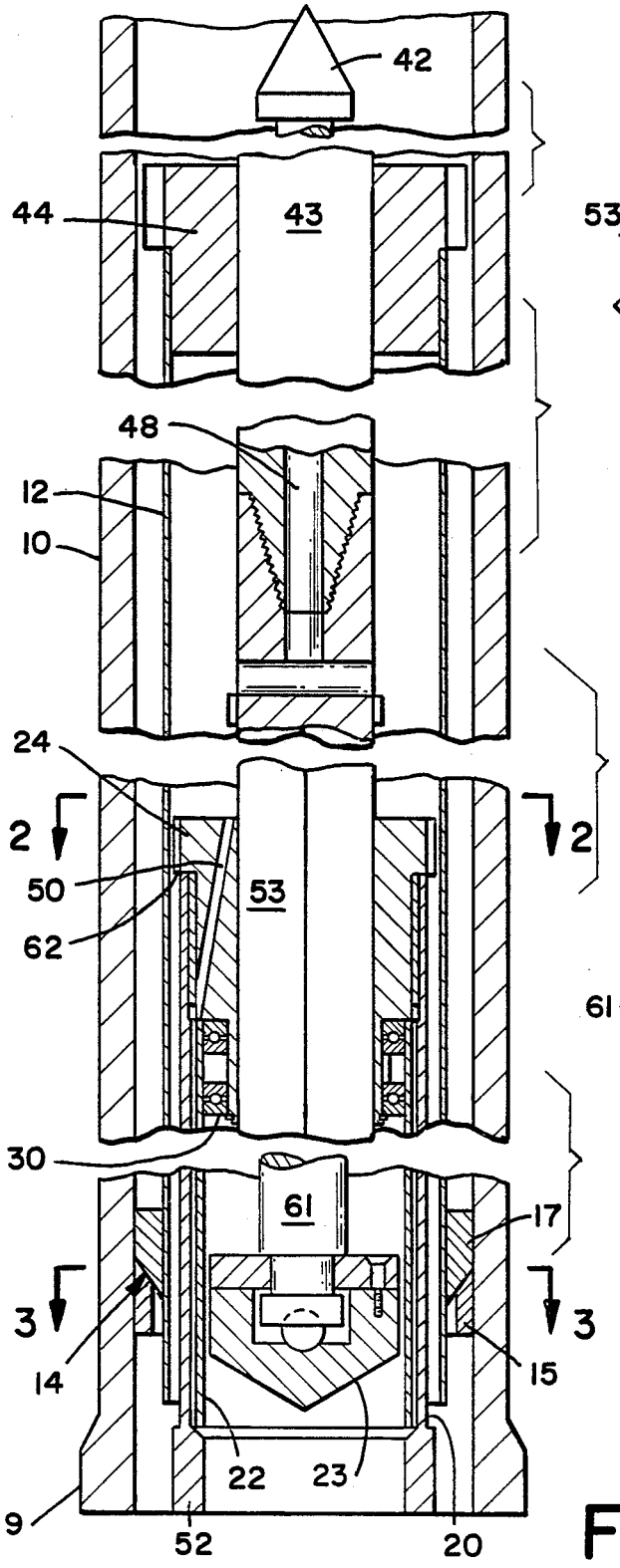
FIG. 1 is a sectional elevation view showing the preferred embodiment of apparatus assembled in accordance with the present invention.

The preferred embodiment of the present invention is illustrated in FIGS. 1–7. A tubular cylindrical sub 10 is adapted to be connected to the lower end of an elongated tubular string such as a drill string. The lower end of the sub may be provided with a drill bit 9. A cylindrical guide tube 12 is removably inserted into the cylindrical sub 10 and forms an annular chamber therewith. Mud seal means shown generally as 14 are formed near the lower end of the tubular sub 10 to close off the annular space between the tubular sub 10 and the guide tube 12. The mud seal means may be formed by a ring member 15 attached to the inside of the tubular sub 10 engaging the flanged portion 17 on the lower end of the guide tube 12. The mud seal means may include a torque locking key 31 to prevent the guide tube from rotating.

An outer cylindrical barrel 12 is rotatably and reciprocally mounted within the guide tube 12. As shown in FIG. 5 the outer cylindrical barrel 20 is extendable out through the lower end of the sub 10. A core barrel 22 is positioned within the outer cylindrical barrel 20. An adaptor collar 24 having an off round central opening therethrough connects the core barrel 22 to the outer cylindrical barrel 20 for reciprocal movement therewith without substantial rotation therewith. Thus, ball bearing race 30 of adaptor collar 24 is used to mount the core barrel 22 within the outer barrel 20 so that the outer barrel 20 may be rotated while the core barrel 22 may remain substantially free of rotation while being extended down into the material which is being sampled.

A mud turbine 40 (FIGS. 4 and 5) is located in the upper portion of the tubular sub 10 and is provided with an upper end 42 adapted for connection with a wire line. Mud turbines are known in the art and provide for translating liquid flow entering the mud turbine's upper port 41 as indicated by arrows in FIGS. 4 and 5 to rotation of shaft 43. The turbine is locked to sleeve 44. The cylindrical rotor shaft 43 of the mud turbine is rotatably journaled through sleeve 44. Sleeve 44 is fixedly connected to the upper end of the cylindrical guide tube 12. The sleeve 44 is removably insertable with the guide tube 12 into the sub 10.

Figure 2:
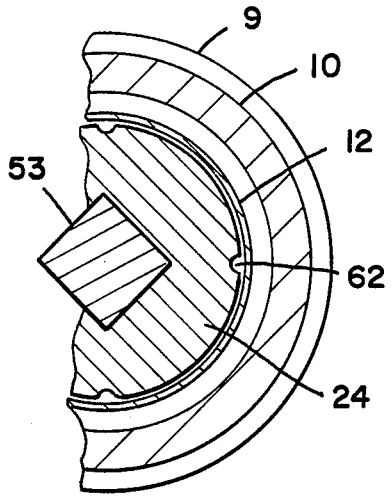
FIG. 2 is a sectional view taken at line 2—2 of FIG. 1.
Figure 3:
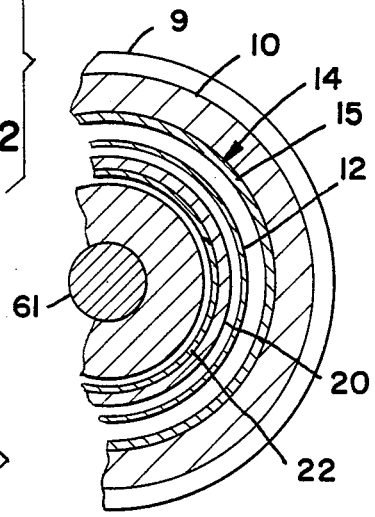
FIG. 3 is a sectional view taken at line 3—3 of FIG. 1.

The rotor shaft 43 has an interior passageway 48 which expels the liquid used by the mud turbine 40 to rotate the shaft into the annular space above adaptor collar 24. The intermediate portion 53 of shaft 43 is off round and preferably of square cross-section as illustrated in FIG. 2. Thus, when the shaft is rotated it will rotate adaptor collar 24 and the outer cylindrical barrel 20 therewith. The pressure of the liquid on the upper surface of adaptor 24 tends to push the adaptor and elements connected thereto out the lower end of the sub 10.

The rotational effect discussed above coupled with the downward force acting on annular bit 52 serve to drill the outer barrel 20 into the material to be samples. The core barrel 22 is extended with the outer barrel 20 without substantial rotation to provide for a better sample of the material. A foot member 23 is connected to the lower end of the shaft and assists in guiding the core barrel if necessary. When the core barrel 22 is fully extended as shown in FIG. 5, the adaptor collar 24 has been moved from the square portion 53 of shaft 43 to a round portion 61 of reduced diameter adjacent foot member 23 so that rotation of the outer barrel 22 stops and the sample may be recovered with minimum disturbance. The effect of the round portion 61 rotating freely within the adaptor collar 24 also causes a pressure drop in the drilling liquid system which is observable at the surface controls and signals termination of the core recovery.

The adaptor collar 24 is provided with a liquid passageway 62 which permits a portion of the liquid coming from the turbine 40 to flow between the guide tube 12 and the outer barrel 20 to facilitate rotation and extension of the outer barrel with respect to the stationary guide tube. A second passageway 50 permits a portion of the turbine drive liquid to flow between the outer barrel 20 and the core barrel 22. This facilitates rotation of the outer barrel while maintaining the core barrel substantially free of rotation as they are extended into the sample.

The sampler of the present invention is wire line operated. The sampler is dropped into the drill string that is full of liquid (drilling mud) and it travels down to the sampling position by its own weight. The sampler is activated by drilling mud pressure from the drilling system on the drill vessel. The sampling operation is monitored by flow and pressure controls of the drilling system. After sampling the sampler is retrieved from the drill string by standard wire line overshot procedure.

Thus, in summary the present invention provides a wire line core sampler for use in a drill string sub. A cylindrical guide tube is removably insertable into the sub. An outer cylindrical barrel is rotatably and reciprocally mounted within the guide tube and is extendable out through the lower end of the sub. A core barrel is positioned within the outer cylindrical barrel. Downhole means responsive to liquid pressure in the drill string are provided for rotating the outer barrel and for extending the outer barrel and the core barrel through the lower end of the sub to take a soil sample.

While certain specific embodiments of the invention have been described in detail the invention is not to be limited to only these embodiments but rather by the scope of the appended claims.

What is claimed is:

1. A wire line core sampler for use in a drill string sub comprising a cylindrical guide tube removably insertable into said sub; an outer cylindrical barrel rotatably and reciprocally mounted within said guide tube and extendable out through the lower end of said sub; a core barrel positioned within said outer cylindrical barrel; and downhole mud turbine means insertable into said drill string sub and connected to said outer cylindrical barrel and responsive to liquid pressure in the drill string for rotating said outer barrel and for extending said outer barrel and said core barrel through the lower end of said sub to take a soil sample.

2. A wire line core sampler for use in a drill string sub comprising a cylindrical guide tube removably insertable into said sub; an outer cylindrical barrel rotatably and reciprocally mounted within said guide tube and extendable out through the lower end of said sub; a core barrel positioned within said outer cylindrical barrel; adaptor collar means connecting said core barrel to said outer cylindrical barrel for reciprocal movement therewith but without substantial rotation therewith; and downhole mud turbine means connected to said outer barrel and insertable into said sub and responsive to liquid pressure for rotating said outer barrel and for extending said outer barrel and said core barrel through the lower end of said sub to take a soil sample.

3. A wire line core sampler for use in a drill string comprising a tubular cylindrical sub connectable to the lower end of a drill string; a cylindrical guide tube removably insertable into said sub; an outer cylindrical barrel rotatably and reciprocally mounted within said guide tube and extendable out through the lower end of said sub; a core barrel positioned within said outer cylindrical barrel; adaptor collar means connecting said core barrel to said outer cylindrical barrel for reciprocal movement therewith but without substantial rotation therewith; downhole mud turbine means insertable into said drill string sub and connected to said outer cylindrical barrel and responsive to liquid pressure in the drill string for rotating said outer barrel for extending said outer barrel and said core barrel through the lower end of said sub to take a soil sample.

4. A wire line core sampler for use in a drill string sub comprising a cylindrical guide tube removably insertable into said sub and forming an annular space therewith; mud seal means for closing off the annular space between said tubular sub and said guide tube and for preventing said guide tube from extending out of the lower end of said sub; an outer cylindrical barrel rotatably and reciprocally mounted within said guide tube and extendable out through the lower end of said sub; a core barrel positioned within said outer cylindrical barrel; adaptor collar means having an off round central opening therethrough connecting said core barrel to said outer cylindrical barrel for reciprocal movement therewith without substantial rotational movement therewith; an elongated rod extending through said off round opening of said adaptor means, said rod having an upper portion shaped to engage said off round opening for rotating said adaptor means and a lower portion shaped to rotate freely within said off round opening; upper sleeve means connected to the upper end of said guide tube, said sleeve means having a central opening therein; a mud turbine connected to said elongated rod through said central opening in said upper sleeve means for rotating said rod; mud exhaust means in said mud turbine for exhausting mud into the space between said adaptor means and said upper sleeve means; and restricted mud flow passageway means permitting a portion of the mud to flow through said adaptor means through the annular space between said guide tube and said outer cylindrical barrel and a portion of the mud to flow through the annular space between said outer cylindrical barrel and said core barrel out of said sub.

5. A wire line core sampler for use in a drill string comprising a tubular cylindrical sub connectable to the lower end of a drill string; a cylindrical guide tube removably insertable into said sub; mud seal means for closing off the annular space between said tubular sub and said guide tube and for preventing said guide tube from extending out of the lower end of said sub; an outer cylindrical barrel rotatably and reciprocally mounted within said guide tube and extendable out through the lower end of said sub; a core barrel positioned within said outer cylindrical barrel; adaptor collar means having an off round central opening therethrough connecting said core barrel to said outer cylindrical barrel for reciprocal movement therewith without substantial rotational movement therewith; an elongated rod extending through said off round opening of said adaptor means, said rod having an upper portion shaped to engage said off round opening for rotating said adaptor means and a lower portion shaped to rotate freely within said off round opening; upper sleeve means connected to the upper end of said guide tube, said sleeve means having a central opening therein; a mud turbine connected to said elongated rod through said central opening in said upper sleeve means for rotating said rod; mud exhaust means in said mud turbine for exhausting mud into the space between said adaptor means and said upper sleeve means; and restricted mud flow passageway means permitting a portion of the mud to flow through said adaptor means through the annular space between said guide tube and said outer cylindrical barrel and a portion of the mud to flow through the annular space between said outer cylindrical barrel and said core barrel and out of said sub.

* * * * *

UNITED STATES PATENT AND TRADEMARK OFFICE

CERTIFICATE OF CORRECTION

PATENT NO. : 4,518,050

DATED : May 21, 1985

INVENTOR(S) : STEINAR SOLLIE; ARILO A. ANDRESEN

It is certified that error appears in the above-identified patent and that said Letters Patent are hereby corrected as shown below:

Claim 3, line 46, should read --therewith; and downhole mud turbine--

Signed and Sealed this

*Twenty-fourth* Day of *September 1985*

[SEAL]

*Attest:*

DONALD J. QUIGG

*Attesting Officer*

*Commissioner of Patents and Trademarks—Designate*